US009656732B1

(12) United States Patent
Samelian

(10) Patent No.: US 9,656,732 B1
(45) Date of Patent: May 23, 2017

(54) RESCUE DEVICE

(71) Applicant: John K Samelian, Mendota Heights, MN (US)

(72) Inventor: John K Samelian, Mendota Heights, MN (US)

( * ) Notice: Subject to any disclaimer, the term of this patent is extended or adjusted under 35 U.S.C. 154(b) by 0 days.

(21) Appl. No.: 14/757,304

(22) Filed: Dec. 15, 2015

Related U.S. Application Data

(60) Provisional application No. 62/124,663, filed on Dec. 29, 2014.

(51) Int. Cl.
*B63C 9/08* (2006.01)
*B63C 9/26* (2006.01)
*B63C 9/00* (2006.01)

(52) U.S. Cl.
CPC ..... *B63C 9/082* (2013.01); *B63C 9/0005* (2013.01); *B63C 9/26* (2013.01)

(58) Field of Classification Search
CPC ..... B63C 9/082; B63C 9/26; B63C 9/0005
See application file for complete search history.

(56) References Cited

U.S. PATENT DOCUMENTS

| | | | | |
|---|---|---|---|---|
| 4,577,262 A * | 3/1986 | Buteaux | B63C 9/22 200/60 |
| 5,562,512 A | 10/1996 | Samelian | 441/81 |
| 8,216,014 B2 | 7/2012 | Samelian | 441/81 |
| 8,708,762 B2 | 4/2014 | Samelian | 441/81 |
| 8,951,081 B2 * | 2/2015 | Grandinetti | B63C 9/082 441/81 |

* cited by examiner

*Primary Examiner* — Stephen Avila
(74) *Attorney, Agent, or Firm* — Jacobson & Johnson LLC

(57) ABSTRACT

A throwable rotateable rescue device with a retrieval cord and a set of peripheral handles that are retained within the rescue ring during storage and throwing of the rescue ring but are automatically extendable to a grasping position without interfering with the rescue device retrieval cord during the flight of the rescue ring thereby enabling a person in distress to easily and quickly grasp the handles and be pulled to safety through the retrieval cord.

16 Claims, 6 Drawing Sheets

RESCUE DEVICE

CROSS REFERENCE TO RELATED APPLICATIONS

This application claims priority of provisional application Ser. No. 64/124,663 filed Dec. 29, 2014.

STATEMENT REGARDING FEDERALLY SPONSORED RESEARCH OR DEVELOPMENT

None

REFERENCE TO A MICROFICHE APPENDIX

None

BACKGROUND OF THE INVENTION

This invention relates generally to rescue devices and, more specifically, to improvements to aerodynamically shaped rescue rings that increases the versatility and capacity of the rescue rings. Examples of lightweight rescue rings, which have an aerodynamic shape, can be found in my U.S. Pat. Nos. 5,562,512; 8,216,014 and 8,708,762. My aerodynamic rescue rings have an excellent throwing range and are ideally suited for water rescue since the rescue rings are buoyant and can be hand thrown by an inexperienced person. Typically, a cord, which is secured to the rescue ring, unwinds from a cord reel located in the rescue ring as the rescue ring is thrown to a person in distress. The other end of the cord, which is retained by the thrower or is affixed to a structure, allows the thrower to retrieve the rescue ring by pulling on the cord. Consequently, when the rescue ring reaches its destination a person in distress grasps the rescue ring and is pulled to safety by the cord, which is attached to the rescue ring. On some occasions one may want to retrieve objects other than a person, for example, one may want to bring a boat into dock or to rescue a boat in distress. To pull larger or various types of loads the rescue ring may not have sufficient structural and tensional integrity since the rescue rings are generally made of lightweight materials so that they can be thrown long distances. In other cases it simply may be inconvenient to attach the rescue ring to an object. In such cases the rescue ring can be used to retrieve a stronger rope, which can then be used to pull the larger load toward the dock or the boat.

SUMMARY OF THE INVENTION

A throwable, rotateable rescue device having a cord wound thereon with the rescue device comprising an annular member having an upper outer peripheral surface having an airfoil shape and an inner upper peripheral surface having an airfoil shape, with the upper outer peripheral surface forming a leading edge of the annular member and the inner upper peripheral surface forming a trailing edge of the annular member as the rescue ring is thrown to a person in distress. The rescue ring includes a set of retractable peripheral handles, which are normally statically stored in a recess in the outer periphery of the rescue ring to provide out of the way handle storage. When the rescue ring is thrown to a person in distress the handles, which are stored within the rescue ring, are automatically extended radially outward by the centrifugal force produced by rotation of the rescue ring without interfering with either the cord attached to the rescue ring or the flight of the rescue ring.

A further feature of the handle storage within the rescue ring is that multiple rescue rings can be compactly stored in a ready to use condition without the concern that the handles may catch or snag on an article either during the removal of the rescue ring from its storage container or the throwing of the rescue ring to a person in distress. Consequently, one can maintain a stack of multiple rescue rings in a ready to use condition so a person can quickly grasp and one by one toss rescue rings to a person or persons in distress.

DESCRIPTION OF THE PREFERRED EMBODIMENT

Figure 1:
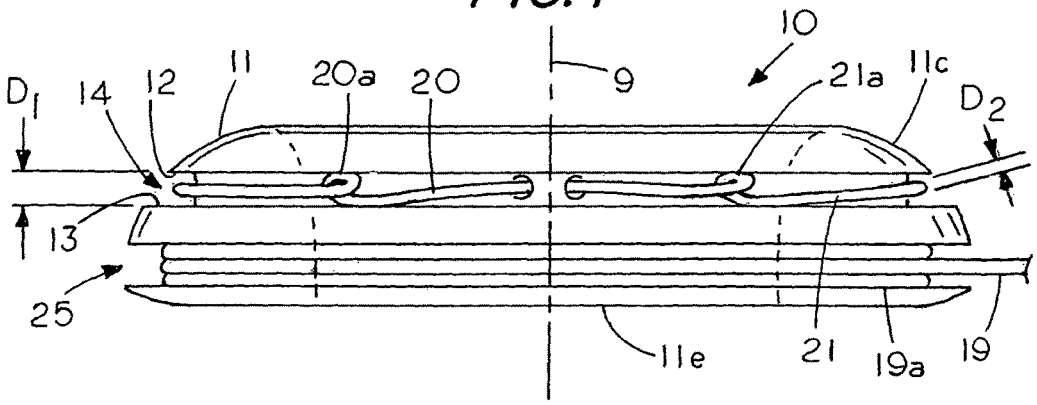
FIG. 1 is a side view of a rescue ring with handles stored within the rescue ring.
Figure 2:
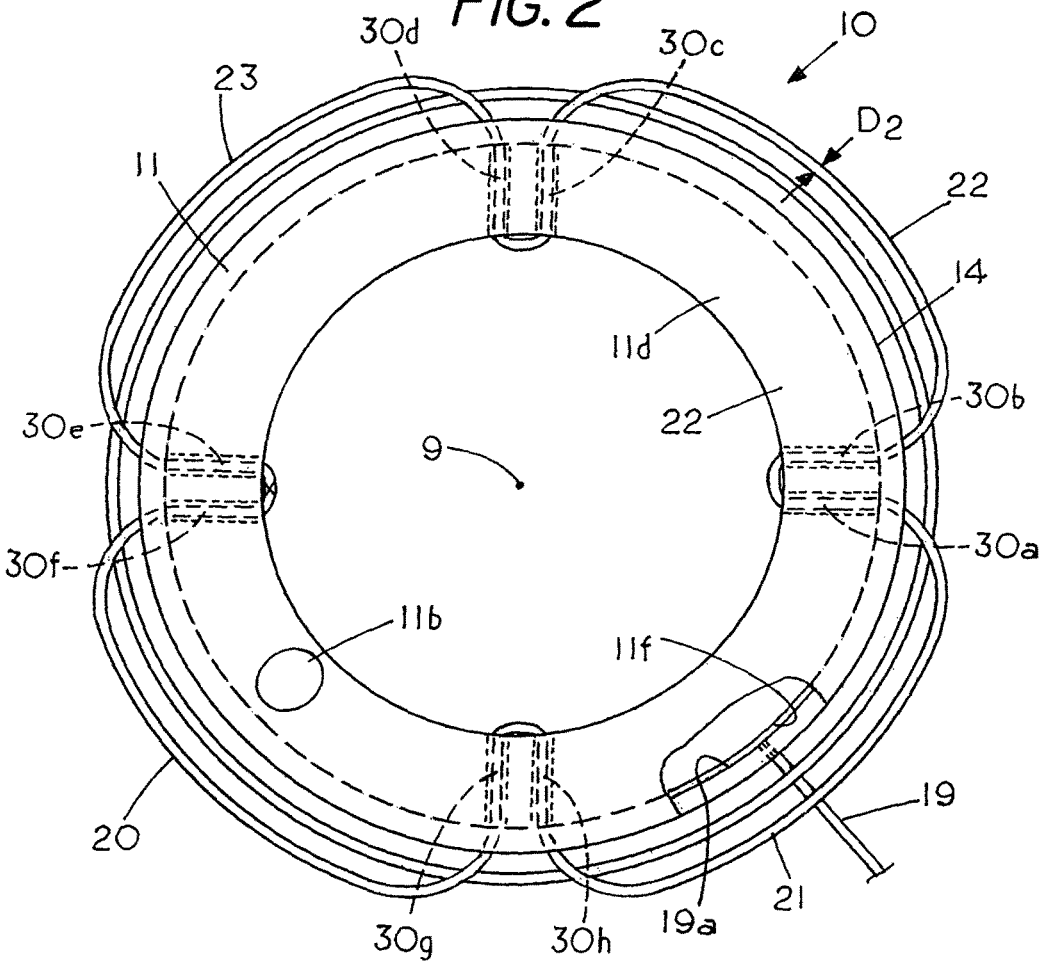
FIG. 2 is a top view the rescue ring of FIG. 1 with the handles in an extended condition.

FIG. 1 is a side view of a rescue device 10 in a ready to throw condition and FIG. 2 is top view of a rescue device 10 after it has been thrown. Typically, rescue device 10 comprises a rescue ring 11 made from a lightweight material that floats if the rescue ring lands on water, however, the rescue ring requires sufficient mass so that the momentum imparted to the rescue ring through hand throwing is sufficient to deliver the rescue ring to its destination. The rescue ring 11 may be molded from a polymer plastic with the material having sufficient tensional strength so that pulling on the cord 19, which is attached to the rescue ring, brings a person holding on to the rescue ring to the thrower. Examples of rescue rings can be found in my U.S. Pat. Nos. 5,562,512; 8,216,014 and 8,708,762, which are hereby incorporated by reference.

FIG. 1 shows rescue device 10 comprises a rescue ring 11 connected to one end of a cord 19 that is wound within a peripheral recess 25 in rescue ring 11. FIG. 2 shows a set of tuckable rope handles or grab loops 20, 21, 22 and 23 with FIG. 1 showing rope handles 20 and 21 are tucked into an annular recess 14 on the front side of the rescue ring 11. Similarly, although not shown, rope handles 22 and 23 are tucked into the annular recess on the backside of rescue ring 11. FIG. 1 shows the coil 20*a* and coil 21*a* formed in the rope handles to frictionally hold the handles within a profile in the rescue ring during the storage and handling phase to prevent the handles from snagging on articles. In this example soft or flexible rope is used. Typically, suitable soft or flexible ropes that can be coiled can be used as tuckable handles and can be made from woven polypropylene or the like since the woven rope is soft and can be formed in a coil on itself. On the other hand if one wants the handles to remain outside the rescue ring during the throwing process a non-woven rope, which is stiffer and usually not tuckable, may be used.

To use rescue ring 11 a person grasps and throws the rescue ring 11 by imparting a rotational motion to the rescue ring 11 which causes the rescue ring 11 to rotate about its central axis 9. As the rescue ring travels outward toward a person in distress the cord 19 unwinds from the rescue ring at the same time the handles 20, 21, 22 and 23 are ejected from the annular recess 14 in the rescue ring. Once the rescue ring 11 lands in the water by a person or persons in distress they can grasp and hold onto the extended handles 20, 21, 22, and 23 (FIG. 2) as the thrower pulls the rescue ring 11 and persons clinging to the rescue ring to safety by pulling on cord 19. In this example the rescue ring includes a first set of handles 20 and 22 that are diametrically opposite to each other and a second set of handles 21 and 23 that are diametrically opposite to each other, preferably to ensure a dynamic balance of the rescue ring as it rotates on its flight to a person or persons in distress. Prior to throwing all the handles 20, 21, 22, and 23 are in a storage or prethrowing condition. FIG. 2 shows the handles 20, 21, 22 and 23 in the extended condition after the rescue ring has been thrown to a person in distress. In the condition shown in FIG. 2 a person or persons can grab onto the rope handles and be pulled to safety through cord 19, which is attached to rescue ring 11.

In this example the set of handles 20, 21, 22 and 23 are located in a top annular slot 14 having a top annular surface 12 and a lower annular surface 13 having a width $D_1$. The handles 20, 21, 22 and 23 have a diameter indicated by $D_2$ with the handle diameter $D_2$ being sufficiently larger than cord width $D_1$ so as to freely fit within slot 14 when the cords are straight. Although the handles can freely fit within the slot 14 it is desired to store the handles in an out of the way condition within the annular recess 14. The storage of the handles in an out of the way condition makes it convenient to store a plurality of rescue rings in a ready to use condition as well as throw the rescue ring. On the other hand it is desirable that the handles protrude from the rescue ring when the rescue ring arrives at the person or persons in distress so the person or persons can quickly grasp the handles and be pulled to safety. A further feature of annular surface 12 is that it may also be used for a finger-grasping surface when the rescue ring is thrown.

The rescue ring shown in FIG. 1 retains the handles 20, 21, 22 and 23 within the slot 14 during storage and launching of the rescue ring but allows for radially extending the handles outward from the rescue ring 11 as the rescue ring is thrown to a person or persons in distress. A feature of the invention is a frictional retention of the rope handles or grab loops in the rescue ring during storage and the use of centrifugal force to automatically extend the rope handles without interfering with the retaining cord as the rescue ring is thrown to a person in distress. In the example shown one twists of a portion of each of the handles 20, 21, 22 and 23 into a coil, which increases the profile of the handle. One then tucks the coil into the annular slot 14 with the top and lower portion of the coil forming frictional engagement with the upper annular sidewall 12 and the lower annular sidewall 13, which frictionally retains the handle within slot 14 until the rescue ring is thrown to a person in distress.

In the example shown in FIG. 1 flexible rope handles, which have one end secured to the rescue ring, are used but other types of handles may be used without departing from the spirit and scope of the invention. FIG. 1 shows a first coil 20*a* in handle 20, which is formed by twisting, handle 20*a* and a second coil 21*a* in handle 21 formed by twisting the handle 21. Next one tucks the handle 20 and coil 20*a* into the annular slot 14 and tucks the handle 21 and coil 21*a* into the annular slot 14. The length of the handles are such that handles will fit within a recess or pocket in the rescue ring. In this example, the coil 20*a* engages both the upper annular sidewall 12 and the lower annular sidewall 13 to frictionally hold the handle 20 within the annular recess 14 during the normal handling and storage of rescue device 10. Similarly, the coil 21*a* on handle 21 engages both the upper annular sidewall 12 and the lower annular sidewall 13 to frictionally hold the handle 21 within the annular recess 14 during the normal handling and storage of rescue device 10. Handles 22 and 23 are similarly frictionally held within annular slot 14 through frictional forces between the handles and the upper annular surface 12 and the lower annular surface 13. Preferably the handles are fitted completely inside the annular recess 14 or sufficiently within the recess so as not to catch or snag during the handling or throwing of the rescue ring. A feature of the invention is that the formation of a coil in the handle not only enables one to frictional hold the handle in the rescue ring it also shortens the handle so the handle can be tucked within the outer pocket or recess in the rescue ring.

Through engaging both the upper annular sidewall 12 and the lower annular sidewall 13 one can frictionally hold the rope handles 21, 22, 23 and 24 within the annular recess 14 during the normal handling and storage of rescue device 10. One method of securing the handles within the rescue ring is through selection of the width $D_1$ of the recess to be slightly less than twice the diameter $D_2$ of the diameter of the rope handles so that one can twist the rope handle on itself to form a coil or loop 20*a* on the rope handle, which increases the top to bottom dimension of the rope at the coil. One can then tuck the coil 20*a* within the annular recess 14 causing the frictional forces on the top and bottom of the coil 20*a* to hold the rope handle in the rescue ring. Similarly, the frictional forces on the top and bottom of the coil 21*a* hold the rope handle 21 in the annular recess 14. Although not shown the rope handles 23 and 24 are similarly frictionally held in annular recess 14 through frictional forces on a coil formed in rope handles 23 and 24. The frictional force exerted on a coil in a rope handle should be sufficiently great such that the weight of the rope handle does not cause the rope handle to fall out of the recess 14 if the rescue ring is held in a vertical orientation. On the other hand the frictional force on the coils should be sufficiently weak so that the centrifugal force on the rope handles, which is generated by the rotation of the thrown rescue ring 11, is sufficient to radially expel the handles from the annular recess 14 in the rescue ring 11. In this example the top annular surface 12 and the lower annular surface 13 are planar surfaces so that any portion of the annular surfaces can be used to frictionally hold the handles within the rescue ring. Although the formation of coils on the rope handles are used to frictional hold the handles within the rescue ring other methods of holding the handles within the rescue ring and the in flight release of the handles may be used without departing from the sprit and scope of the invention.

As shown in FIG. 1 and FIG. 2 rescue ring 11 comprises an annular member having an upper outer peripheral top surface 11*c* having an airfoil shape and an inner upper peripheral surface 11*d* having an airfoil shape, with the upper outer peripheral surface forming a leading edge of the annular member and the inner upper peripheral surface forming a trailing edge of the annular member. A lower annular bottom surface 11*e* comprises a plane surface, however, other shapes may be used as shown and described without departing from the spirit and scope of the invention. In the example shown a thumb grip 11*b*, which may be a slight dimple, enables a user grasp the top of ring 11 with his or her thumb while the users fingers can grasp the lower surface 11*e*. The rescue ring is thrown like a Frisbee, which enable the user to impart rotational momentum to the rescue ring as the rescue ring is thrown to a person or persons in distress.

Figure 3:
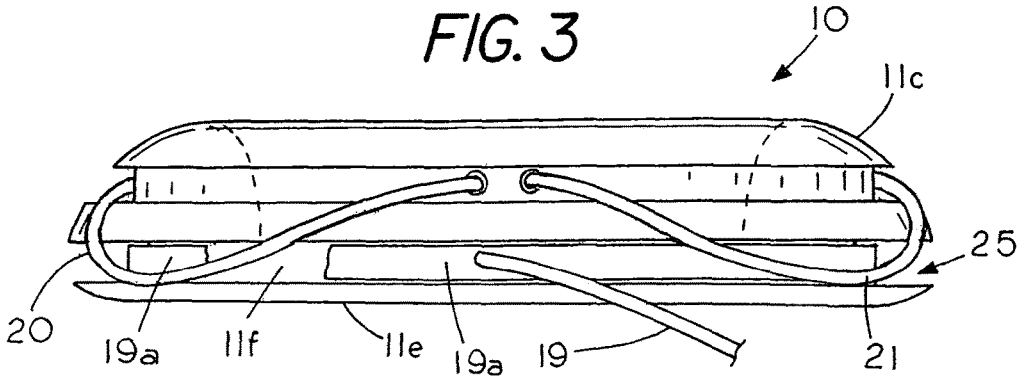
FIG. 3 is side view of a rescue ring of FIG. 1 with the handles in an extended and relaxed condition after the rescue ring has been thrown to a person in distress.

FIG. 2 shows a top view of rescue ring 10 after arriving at a person in distress. In this condition the cord 19 extends back to the thrower and the handles 21, 22, 23 and 24 are extended radially outward for grasping by the person in distress. In this example each of the handles have a pair of ends that are secured to the rescue ring by extension of the handles through opening in the rescue ring as shown by radial openings 30*a*, 30*b*, 30*c*, 30*d* 30*e*, 30*f*, 30*g* and 30*h*. FIG. 3 shows a side view of the rescue ring after the rescue ring lands by a person in distress. Note, the rope handles 20 and 21 as well as handles 23 and 24 (not shown) hang downward from the rescue ring 10 for ease in grasping by a person in distress. FIG. 3 shows rope handles 20 and 21 extending over the annular recess 25 where the cord 19 is normally stored. In this example one end of cord 19 attaches to a slip ring 19*a*, which rotates on cylindrical bearing surface 11*f*. If the rope handles extend over the recess 25 during flight the retrieval cord 19 it can cause interference with the throwing and flight of the rescue ring.

Figure 5:
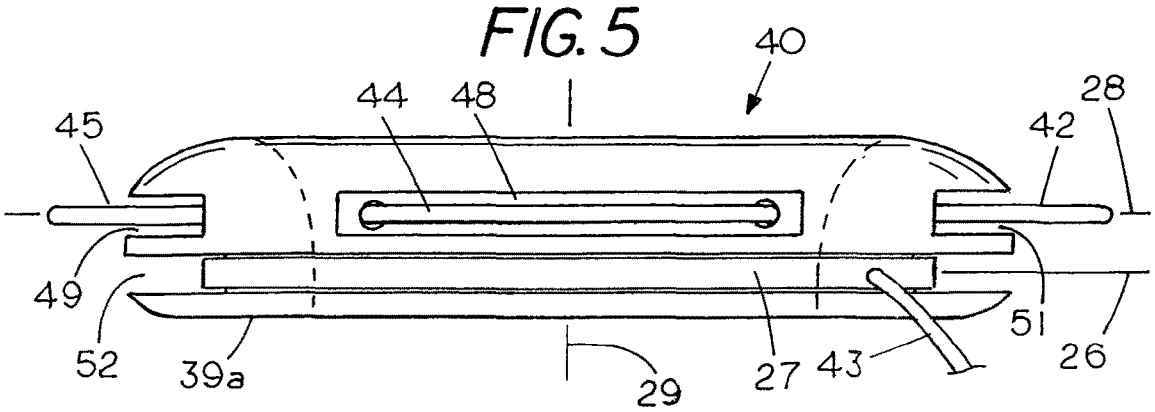
FIG. 5 is a top front view of the rescue ring of FIG. 4 showing the handles extending radially outward during the flight of the rescue ring.

In the example shown in FIG. 5, the annular recess 14 for the rope handles 42 and 45 as well as diametrically opposite handles thereto (not shown) are positioned axially above the annular recess 52 for the cord 43. This feature allows one to utilize the centrifugal forces on the handles and the gravitational forces on retrieval cord 43 to prevent entanglement or interference of the handles with the retrieval cord as the cord 43 unwinds from the rescue ring 40 during the flight of the rescue ring to a person in distress. That is, in the flight condition the annular recess 49 is located along axis 29 but vertically above the annular recess 52 that contains the retrieval cord 43. When the rescue ring 10 is thrown the user imparts a rotational motion to the rescue ring, which generates sufficient centrifugal force to throw the handles radially outward from the slot 14. In addition to the handles being thrown out of the recess the centrifugal force on the handles generated by the continued rotation of the rescue ring causes the handles to extend in the a plane substantially perpendicular to the axis 29. In this example the annular slot 52 is located below the annular slot 51 for the handles. In this condition the rotating handles, which extend from annular slot 52, do not interfere with the retaining cord 43 unwinding from annular slot 25 on the lower part of the rescue ring 40. That is, the cord 43 unwinds from the rescue ring as it travels to the person in distress and at the same time the cord 43 falls downward due to the gravitational force on the cord thus keeping the cord 43 out of the plane of the rotating handles. In this example the handles for the rescue ring 40 are located above or on topside of the rescue ring and are automatically extended radially outward due to the centrifugal force on the handles, which holds the handles in a plane normal to the axis 29 and above the plane of the annular recess 25, which prevents the rotating handles from interfering with cord 43 that extends downward from the rescue ring to the thrower.

Figure 4:
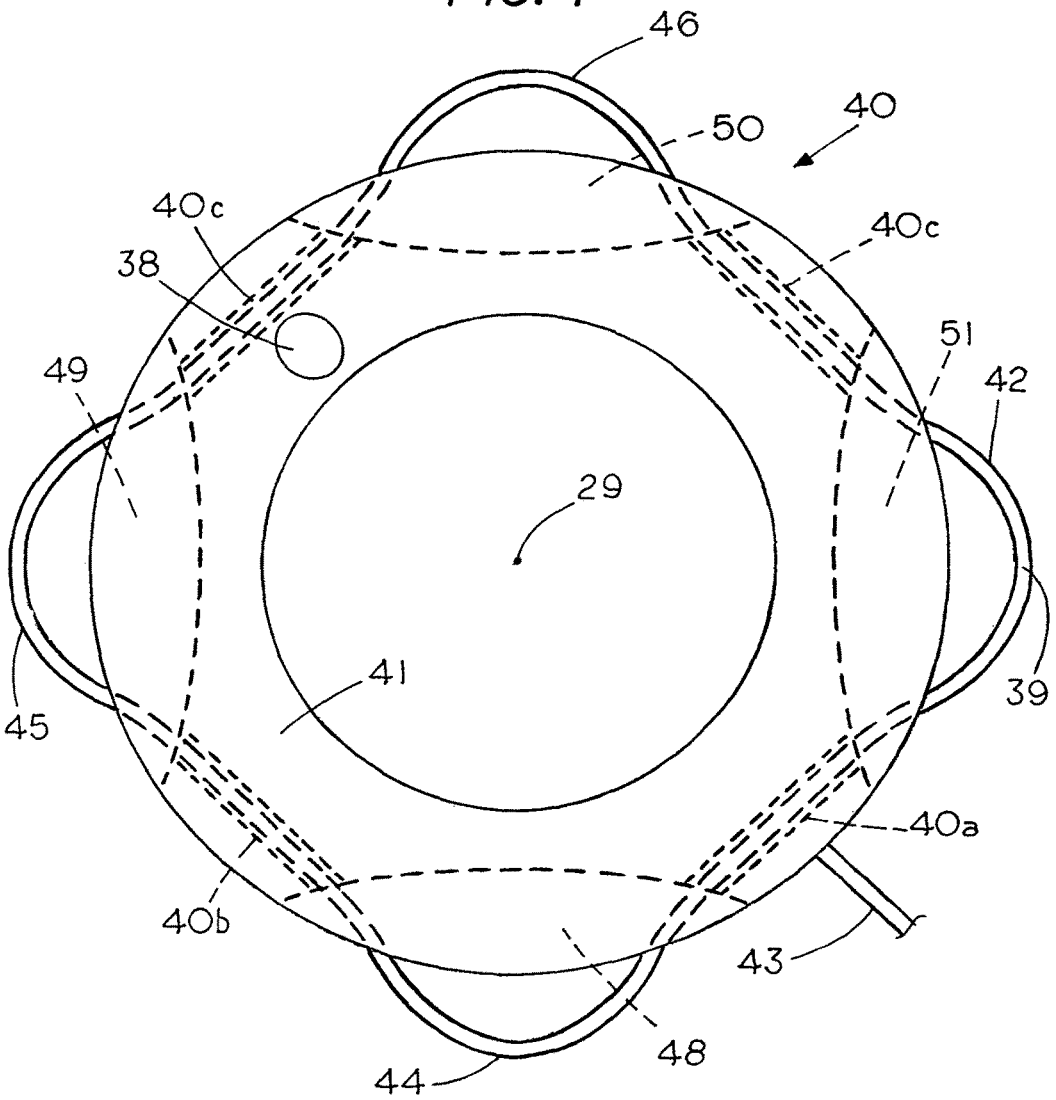
FIG. 4 is a top view of a rescue ring in flight showing the handles extending radially outward from the rescue ring.

FIG. 4 shows rescue ring 40 with the handles 42, 44, 45 and 46 in an extended condition due to centrifugal forces acting on the handles as the rescue ring 40 rotates about central axis 29. In this example instead having an annular slot for holding the rope handles each of the handles contains a pocket for storage of a handle. That is handle 42 includes a pocket 51, handle 40 includes a pocket 50, handle 45 includes a pocket 49 and handle 44 includes a pocket 48. In this example an endless rope 39 extends through internal slots 40*a*, 40*b*, 40*c* and 40*d*. In this example the pockets 48, 49 50 and 51 located in the rim of the rescue ring can be used to store and retain the handles similarly to the annular slot in the rescue ring of FIG. 1. Handles 42, 44, 45 and 46 can also be twisted into a coil and frictionally secured between the upper and lower surfaces in their respective pockets 48, 49, 50 and 51 so that centrifugal forces extends the handles during rotational flight of the rescue ring 40. To aid in imparting rotation to the rescue ring 40 there is included a thumb recess 38 for grasping the top of the rescue ring while the finders grasp the underside 39*a* (FIG. 5).

FIG. 5 shows a front view of rescue ring 40 in a flight condition. The handles 42, 44, 45 and 46 (not shown) extend radially outward in a plane 28 and the slip ring 27, which is attached to cord 43 is located in a plane 26 which is axially below the plane 28 of the handles. Note, cord 43 extends downward due to gravitational forces so that cord 43 is free to unwind from the rescue ring 40 without interfering with the centrifugally extended handles since the handles are located in the plane 28 above the plane 26 of the rescue cord 43, which trails the rescue ring and sags downward due to gravitational forces. Although my rescue ring is shown with a retrieval cord mounted on the rescue ring if desired the rescue ring may be used without a retrieval cord. In this instance the flotation of the rescue ring can support a person until aid arrives.

In the example shown four rope handles are provided with each of the rope handles located diametrically opposite from another rope handle in order to maintain a dynamic balance of the rotating ring. More or less handles may be used without departing from the spirit and scope of the invention. Also while flexible rope handles are shown in other example one may use semi-rigid handles or rigid handles, which are held in a plane above the retrieval line by centrifugal force without departing from the spirit and scope of the invention.

Figure 6:
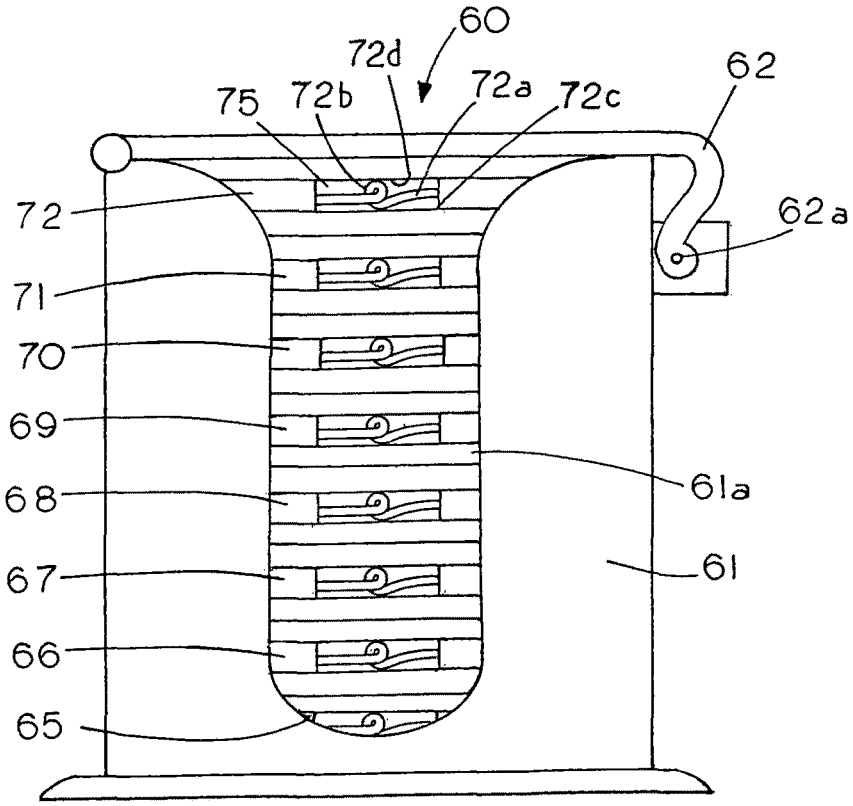
FIG. 6 is a front view of a storage container containing multiple rescue rings.

FIG. 6 shows a horizontal rescue ring storage station 60 holding rescue rings 65, 66, 67, 68, 69, 70, 71, and 72 with the rings stacked on top of each other in a cylindrical container 81 having a hinged top lid 62 and a front access port 61 that reveals the rescue ring contents of the storage station. In this example a pin 62*a*, which contains an alarm, extends through the top lid 62 to maintain the lid 62 in a closed condition. When pin 62*a* is removed the alarm sounds to alert persons that the rescue rings have been accessed. In other examples the pin 62*a* may include a wired or wireless transmitter that transmits to the bridge or pilot of the boat to alert the captain that the storage container 62 for rescue rings has been breached and that there are persons overboard, which allows the captain to immediately cut power and take whatever maneuver is necessary.

While each of the rescue rings are in a stored condition the rescue rings are also in a "ready to throw" condition so that crew or passengers can quickly throw the rescue ring to persons in distress. For example, rescue ring 72 includes a handle 72*a* that is stored within an annular recess 75. Handle 72*a* contains a coil 72*b* formed therein to frictional retain the rope handle 72*a* within annular recess 75 during the removal of the rescue ring from the station 60 and the normal handling of rescue ring 72*a*. FIG. 6 shows a bottom side one of the rescue rings is supported by a topside of an adjacent rescue ring, which is located beneath it. As illustrated station 60 maintains the rescue rings 65, 66, 67, 68, 69, 70, 71, and 72 in an orderly condition so one can open lid 62, grasp the top rescue ring 72 and immediately throw it to a person in distress. If desired one may store the rescue rings in a vertical condition so the rings are ready for use and can be quickly grabbed for throwing. If there are multiple persons in distress one merely grasps the next rescue ring and tosses it to other persons in distress. Since each of the rescue rings are stored in a "ready to throw" condition an operator can quickly deliver a number of rescue rings to persons in distress. In order to increase the storage capacity the rescue rings may contain a lower section of closed cell foam that allows one to compress the rescue rings when they are stacked in a bin next to each other. Upon removal of a rescue ring the closed cell foam expands to normal size for throwing.

Rescue rings of different diameter may be used for different applications and it is envisioned that a set of rescue rings may include four flotation rings, for example one rescue ring may have a 17" diameter for assistive flotation of a single person, a medium size ring with a 20" diameter for assistive flotation of two persons and a larger diameter rescue ring with a 24" diameter for assistive flotation of three persons thus offering a rescuer the option to throw the appropriate flotation device to the person or persons on distress and a 30" diameter ring for larger rescue operations. For example, if two persons are in distress the quickest rescue action may be throw the 20" diameter rescue ring that can provide assistive flotation for two persons. Similarly, if more than two persons are in distress the larger 24" diameter rescue ring can be thrown which provides assistive flotation for all the persons in distress until more rescue rings can be thrown to the persons in distress.

Figure 7:
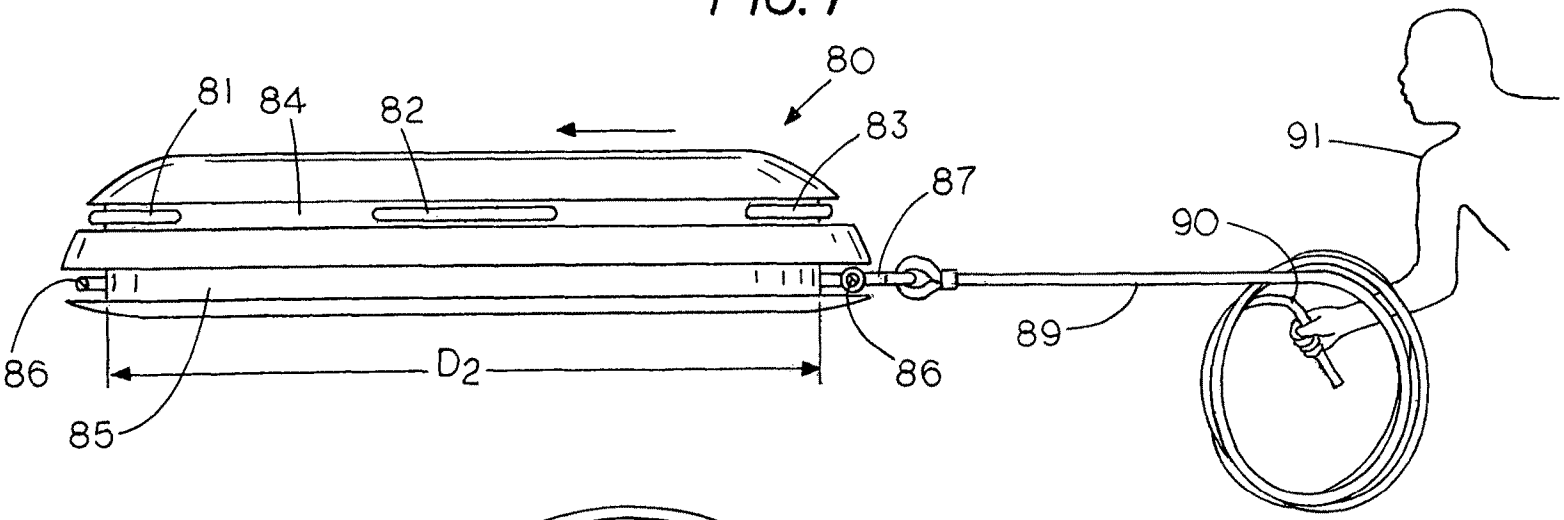
FIG. 7 is a side view of a rescue ring with a slip ring an external retrieval line.

My aerodynamic rescue rings may be made in a variety of sizes with various features for different size rescue rings. FIG. 7 shows a large rescue ring 80, which may typically have a diameter of 30 inches or above. In a large ring the winding of the rescue rope on the rescue ring can increase the weight of the rescue ring to a point where it may difficult for a person to throw the rescue ring. I reduce the force necessary to throw the large rescue ring 80 by maintaining the rope 89 in a hand held coil 90 outside of the rescue ring rather than storing the rope 89 on the rescue ring. The coil 90 is held by a person 91 who throws the rescue ring. In this example the retrieval rope 90 does not have to be thrown but is unwound from the coil as the rescue ring pulls the rope from the persons hand during the flight the flight toward a person in peril, which makes it easier to throw the larger rescue ring or to retrieve the rescue ring and rethrow the rescue ring in the event the first toss did not arrive at the proper site. If desired a low friction material can be used in the rescue ring to enable the free rotation of the slip ring in the rescue ring.

The example of FIG. 7 shows the rescue ring 80 includes a set of four handles 81, 82, 83 and a fourth handle located on the opposite side of the rescue ring 80. The handles are tucked in the slot 84 and are extendable outward through centrifugal force. A lower annular slot 85, having a diameter $D_2$ includes a slip ring 86, which is shown in section. The slip ring 86 is shown in isolated view in FIG. 8 and comprise a circular hoop having an inside diameter $D_1$ which is slightly greater than the diameter $D_2$ so that the rescue ring 80 is free to rotate about the slip ring 86 as the rescue ring is tossed to a person in distress. The freedom of the rescue ring 80 to rotate independent of the slip ring 86 allows one to rotationally throw the rescue ring 80 to obtain the benefit of the aerodynamic shape of the rescue ring. The positioning of the slip ring 85 and the annular slip ring slot 85 below the slot 84 for the handles ensures that the rope handles and the retrieval rope 89 do not interfere with each other during the flight of the rescue ring. That is, during flight the rescue ring 80 rotates with respect to the slip ring 86, which maintains its orientation as it pulls rope 89 from the rope coils 90 held by person 91. Thus, in the embodiment of FIG. 8 the rescue ring 80 pulls the retrieval rope 89 through the air, which takes less energy than throwing the entire weight of the rescue ring and unwinding the rope from the rescue ring 80 as the rescue ring travels to a person in distress. Consequently, with this embodiment shown in FIG. 7 one can maintain a longer throwing range. In addition this feature allows one to quickly retrieve and throw the rescue ring if the rescue ring does not arrive at the person in distress. A further feature is that the design allows for left handed or right handed throwing with equal effectiveness. In the example shown in FIG. 7 there is included an annular recess 84 for the handles, however, in other embodiments the annular recess may be omitted, particularly if the handles are rigid and extend outward from the rescue ring.

Figure 8:
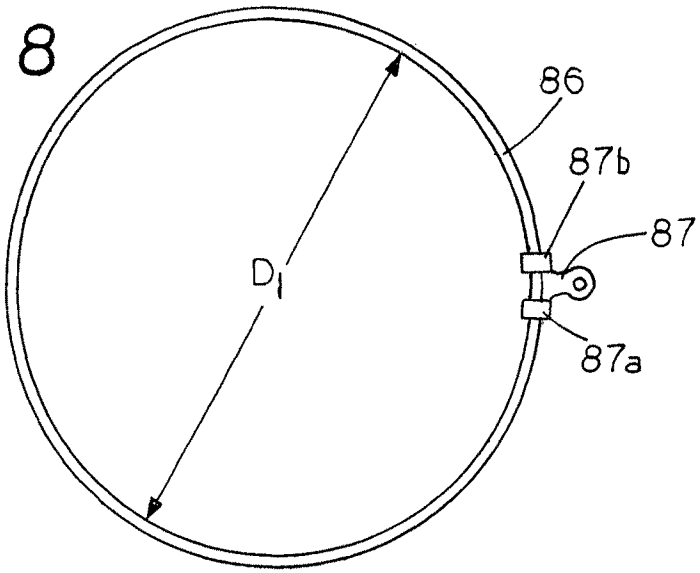
FIG. 8 is a top isolated view of a rigid slip ring for the rescue ring of FIG. 7.

FIG. 8 shows the slip ring 86 includes a connecting link 87 which may include a turnbuckle that has threads on one end 87*b* that can screw into a first set of threads on first end of slip ring 86 and a second set of threads 87*a* on a second end of the slip ring to hold the slip ring. The turnbuckle 87 allows one to connect threaded ends of the slip ring 86 to each other to form a ring that can be maintained in the annular slot 85 on rescue ring 80. That is, once in place the turnbuckle 87 can be secured to the threaded ends of the slip ring 86 allowing one to mount the slip ring 86 within the annular slot 85.

Figure 9:
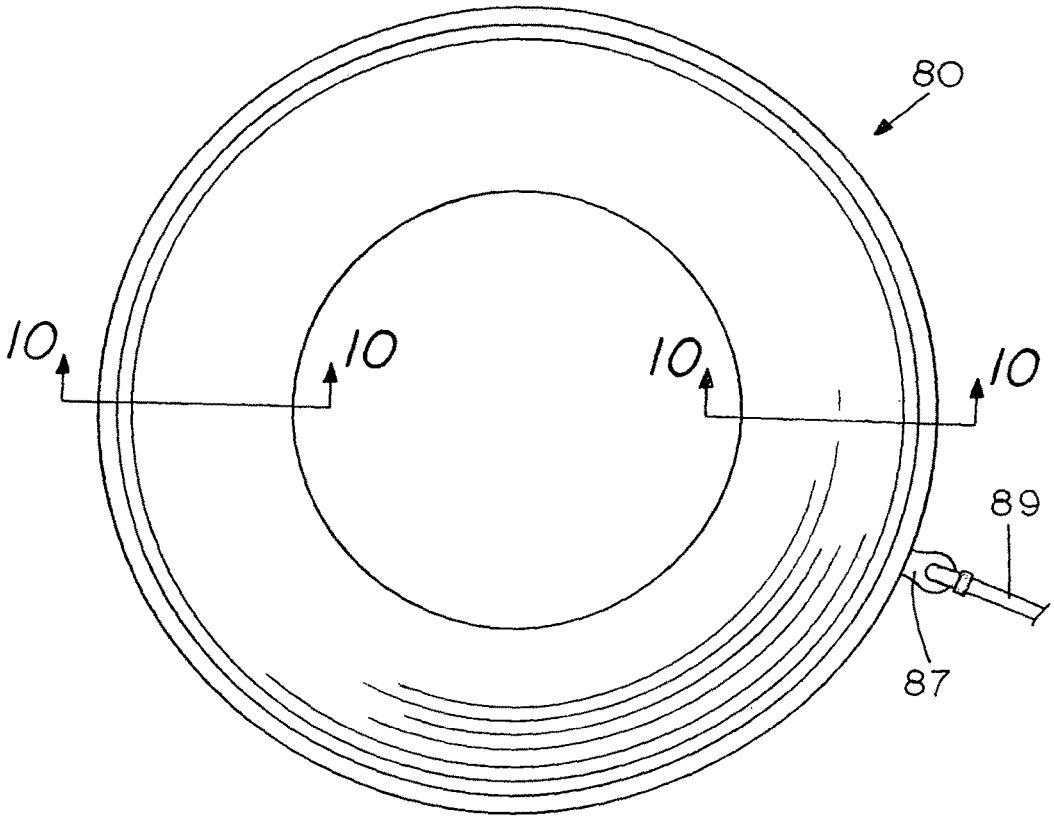
FIG. 9 is a top view of the rescue ring of FIG. 7.

FIG. 9 is a top view of rescue ring 80 showing the retrieval rope 89 extending from the turnbuckle 87, which holds the ends of the slip ring to each other.

Figure 10:
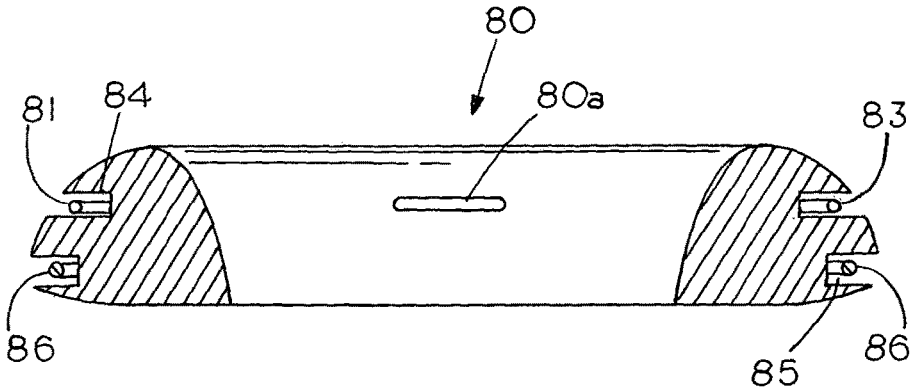
FIG. 10 is a sectional view taken along line 9-9 of FIG. 8.

FIG. 10 is a cross sectional view of rescue ring 80 taken along lines 10-10 of FIG. 9 revealing a finger pocket 80*a* located on inside face of the rescue ring 80. The finger pocket 80*a* is sufficiently wide so that it allows one to insert his or her fingers into the pocket 80*a*, which increases the throwers grip, a feature beneficial on large rescue ring, which are usually thrown with an underarm motion as opposed to the Frisbee like throwing motion of the smaller rescue rings.

Figure 11:
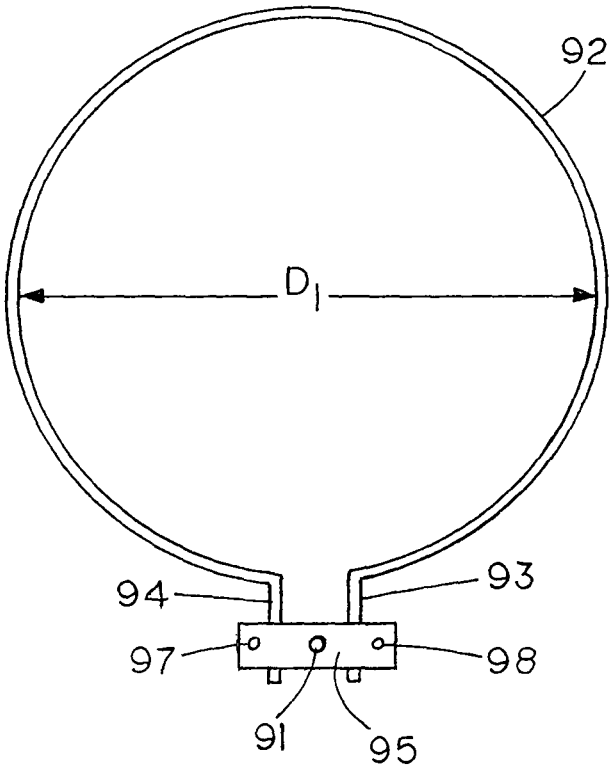
FIG. 11 is a top isolated view of an alternate embodiment of a slip ring for use in the rescue ring of FIG. 7.

FIG. 11 is a top isolated view of an alternate embodiment of a slip ring 92 for use in the rescue ring of FIG. 7. Slip ring 92 includes a first end 93 and a second end 94 that extend perpendicularly outward from the ring 92 and are integral to the slip ring 92. A clamp 95 extends across the two projecting ends 93 and 94 and is secured in a clamping condition to the ends 93 and 94 through a bolt 97 and a bolt 98 that extends through the clamp 95. A hole 96 in the clamp 95 allows one to fasten the retrieval rope thereto. This embodiment allows one to fasten the slip ring into an annular slot in the rescue ring after the annular slot in the rescue ring has been formed.

I claim:

1. A hand throwable rotateable rescue ring comprising:

an annular member having an outer peripheral surface having an airfoil shape and an inner peripheral surface having an airfoil shape, with the outer peripheral surface forming a leading edge of the annular member, said annular member having a first peripheral recess for storing and unwinding a cord therefrom as the rescue device is thrown and a second peripheral recess axially spaced from the first peripheral recess;

a retrieval cord located in said first peripheral recess; and a set of radially extendable handles located in said second peripheral recess with said set of radially extendable handles extendable radially outward from the rescue ring in response to flight rotation of the rescue ring and without interference with the cord as the rescue ring is thrown to a person in distress.

2. The throwable rotateable rescue device of claim 1 wherein the first peripheral recess and the second peripheral recess are axially spaced with each other with the first peripheral recess located proximate a base of the rescue ring.

3. The throwable rotateable rescue device of claim 1 wherein the set of radially extendable handles comprise rope handles.

4. The throwable rotateable rescue device of claim 3 wherein each of the rope handles are twisted on themselves to frictionally engage a top sidewall and a bottom sidewall of the second peripheral recess with sufficient frictional force to maintain the rope handles within the rescue ring during storage and handling of the rescue ring but insufficient frictional force to maintain the rope handles within the rescue ring as the rescue rotates on its delivery to a person in distress.

5. The throwable rotateable rescue device of claim 3 wherein the rope handles comprise at least two rope handles located diametrically opposite from each other.

6. The throwable rotateable rescue device of claim 3 wherein the rescue ring includes a thumb pocket and a lower surface for finger gripping to enable a user to impart rotation to the rescue ring as the rescue ring is thrown to a person in distress.

7. The throwable rotateable rescue device of claim 1 wherein the cord is secured to the rescue ring through a slip ring that enables independent rotation of the slip ring with respect to the rotation of the rescue ring.

8. The throwable rotateable rescue device of claim 1 wherein the second peripheral recesses extends 360 degrees around the rescue ring.

9. A throwable rotateable rescue device comprising:

an outer peripheral surface having an airfoil shape and an inner peripheral surface having an airfoil shape, with the outer peripheral surface forming a leading edge of a rescue ring, said rescue ring having a retrieval cord attached thereto;

a radially extendable handle located in said rescue ring with said radially extendable handle extendable radially outward from the rescue ring in response to flight rotation of the rescue ring;

a retrieval cord attached to a slip ring located proximate a bottom surface of the rescue ring; and a clamp secured to the slip ring for mounting of the slip ring to the rescue ring after formation of the rescue ring.

10. The throwable rotateable rescue device of claim 9 wherein the handle is located proximate a top surface of the rescue ring and includes at least two radially extendable handles each having a pair of ends secured to the rescue device.

11. The throwable rotateable rescue device of claim 9 wherein the at least two radially extendable handles are located diametrically opposite from each other and are of similar mass to maintain a dynamic balance when the rescue device is thrown and the rescue ring includes a finger pocket on an inside of the rescue ring for grasping of the rescue ring during an underhand throw of the rescue ring.

12. The throwable rotateable rescue device of claim 11 wherein each of the handles are frictionally held within a recess in the rescue ring.

13. The throwable rotateable rescue device of claim 11 wherein the handles are rope handles each having a coil formed therein for frictionally holding the handle within a profile in the rescue ring during a storage and handling phase but not during rotational flight of the rescue ring.

14. A rescue station comprising:

a container;

a plurality of rescue rings wherein the rescue rings are side by side each other in the container with each of the rescue rings having a dynamically extendable handle retracted into an a recess in the rescue ring; and a hand access port in the rescue station for accessing one of the plurality of the rescue rings and removing the one of the plurality the rescue ring from the rescue station;

a cover and an alarm to alert a person to a removal of the cover from the rescue station wherein each of the rescue rings include at least two rope handles with a coil formed in each of the rope handles for frictional retaining the rope handles in the rescue ring during handling of the rescue ring but releasing the at least two rope handles when the rescue ring is thrown to a person in distress.

15. The rescue station of claim 14 wherein each of the rescue rings include radially extendable rope handles tucked into a peripheral pocket in the rescue ring.

16. The rescue station of claim 15 wherein a bottom side of one of the rescue rings is supported by a topside of an adjacent rescue ring.

* * * * *